US005702198A

United States Patent [19]

Kuo

[11] Patent Number: 5,702,198

[45] Date of Patent: Dec. 30, 1997

[54] UMBRELLA ROD STRUCTURE OF MULTIPLE TUBES

[76] Inventor: Chin Song Kuo, No. 27-1, Lane 188, Chin Mar Road, Sec. 3, Chang Hua, Taiwan

[21] Appl. No.: 634,607

[22] Filed: Apr. 18, 1996

[51] Int. Cl.[6] ..... A45B 19/00; F16B 7/10

[52] U.S. Cl. ..... 403/377; 403/109; 135/25.1; 135/25.4

[58] Field of Search ..... 135/25.1, 25.4; 403/377, 378, 380, 109, 329, 325, 104

[56] References Cited

U.S. PATENT DOCUMENTS

| | | | |
|---|---|---|---|
| 4,858,633 | 8/1989 | Yang | 135/25.4 |
| 5,287,869 | 2/1994 | Wu | 135/25.1 |
| 5,387,048 | 2/1995 | Kuo | 135/25.1 X |

FOREIGN PATENT DOCUMENTS

| | | | |
|---|---|---|---|
| 866260 | 7/1941 | France | 135/25.1 |
| 217651 | 10/1961 | Germany | 135/25.4 |
| 260456 | 7/1949 | Switzerland | 135/25.4 |

*Primary Examiner*—Harry C. Kim

*Attorney, Agent, or Firm*—Morton J. Rosenberg; David I. Klein; Jon Y. Lee

[57] ABSTRACT

The present invention relates to an umbrella rod structure having multiple tubes. The rod comprises at least two tubes, such as an outer tube and an inner tube, which have arched grooves and positioning holes, and a V-shaped stopper having a projection on one end disposed in the inner tube to extend from positioning holes of both tubes. The arched contacts between the grooves of both tubes and the engagement of the projection and the positioning holes make the rod be secure and firm when it is stretched while the structure of the invention is simple and the manufacturing and assembling is easy and convenience.

1 Claim, 5 Drawing Sheets

UMBRELLA ROD STRUCTURE OF MULTIPLE TUBES

BACKGROUND OF THE INVENTION

As shown in FIGS. 1 and 2, a prior known umbrella rod consisted of multiple tubes includes at least an outer tube (2) and an inter tube (1) between which a connector (3) is used to combining both. The connector (3) includes two stoppers (4), (5) having springs (41), (51) there around to engage with the outer tube (2) and the inner tube (1) perspectively. The two stoppers (4), (5) are at different level, this makes the manufacturing and assembling of the umbrella rod become difficult and troublesome.

SUMMARY OF THE INVENTION

In view of the above problem, the primary object of the present invention is to provide an improved connecting structure of umbrella rod having at least two tubes, which are capable of being easily connected and assembled. The structure of this umbrella rod can also obtain a secure positioning when the rod is stretched.

The present invention will now be described in detailed with reference to the accompanying drawings.

DETAILED DESCRIPTION OF A PREFERRED EMBODIMENT

Figure 1:
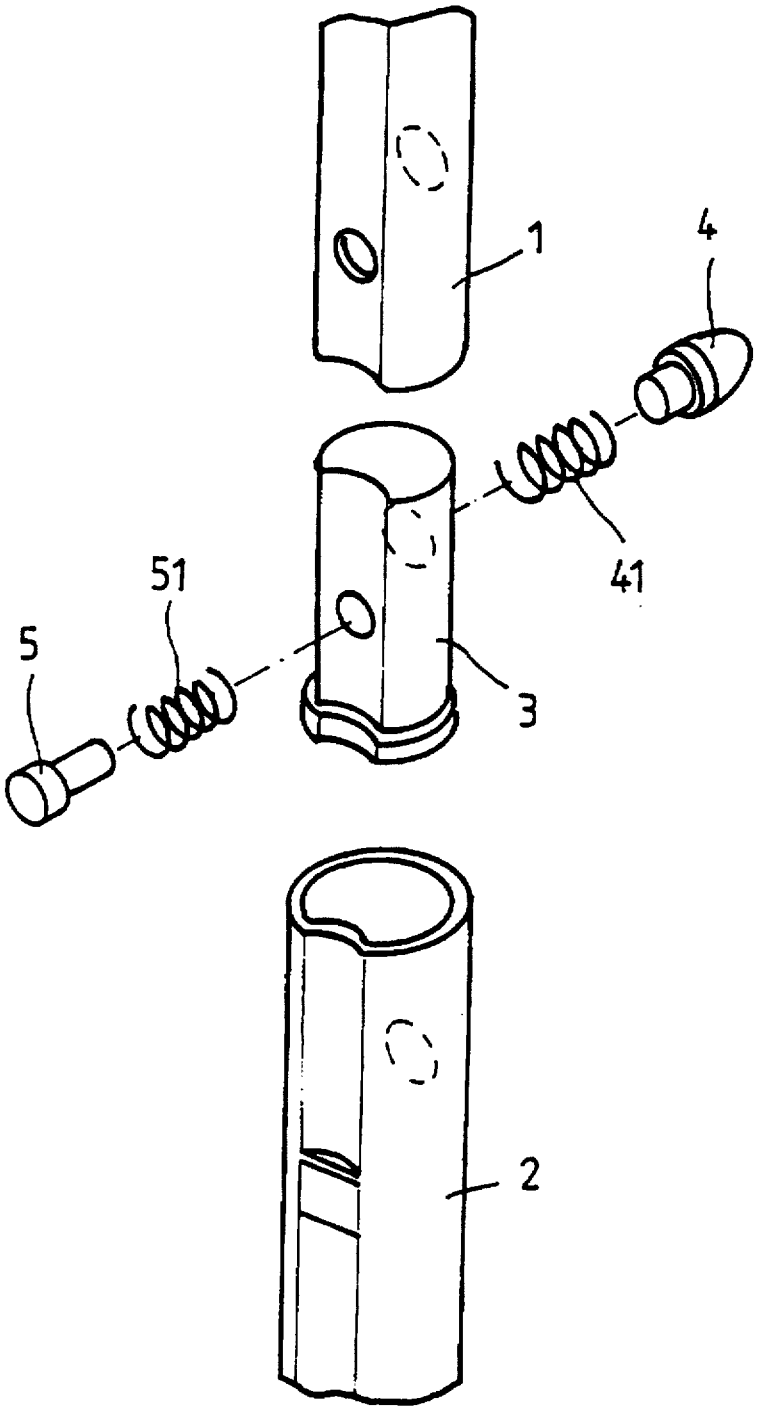
FIG. 1 (prior art)
FIG. 1 is an exploded perspective view of parts of a prior known umbrella rod.
Figure 2:
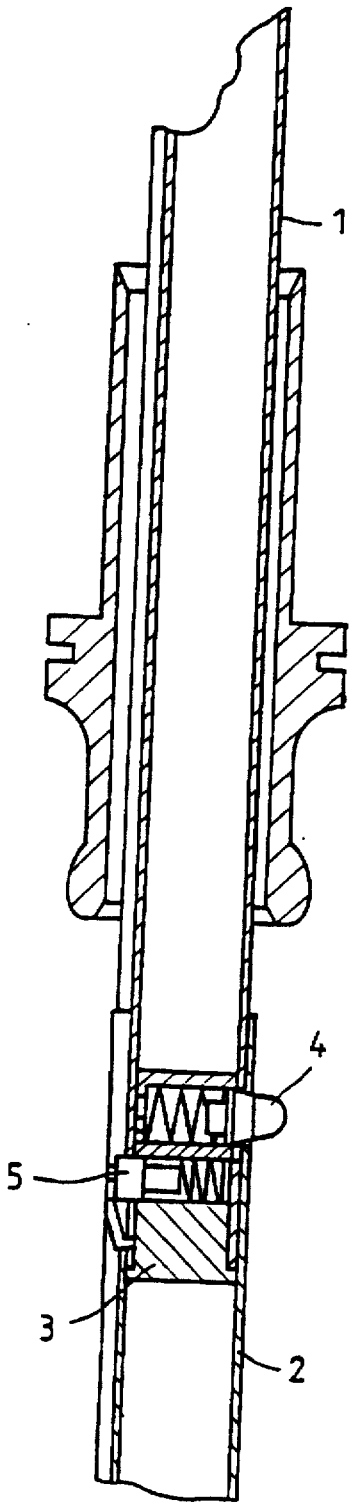
FIG. 2 (prior art)
FIG. 2 is a cross sectional plan view of parts of a prior known umbrella rod in assembly.
Figure 3:
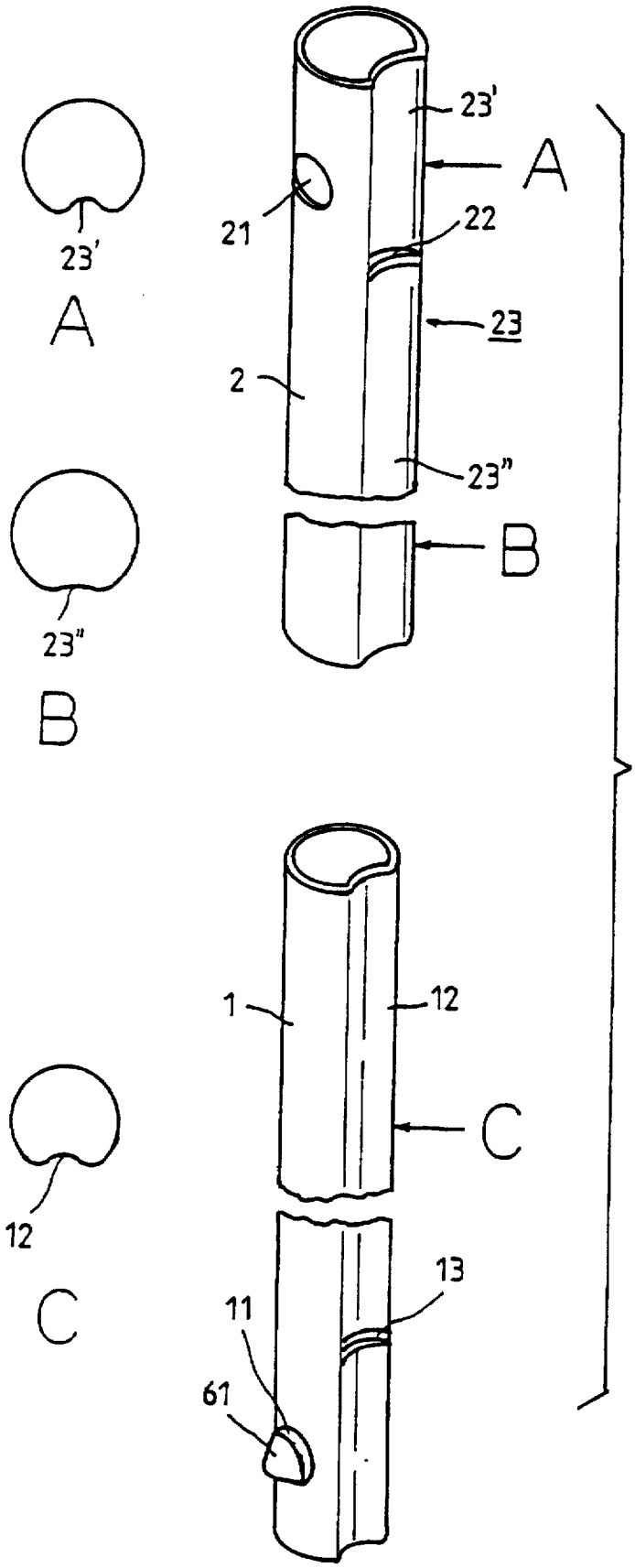
FIG. 3 is an exploded perspective view of parts according to the present invention.
Figure 4:
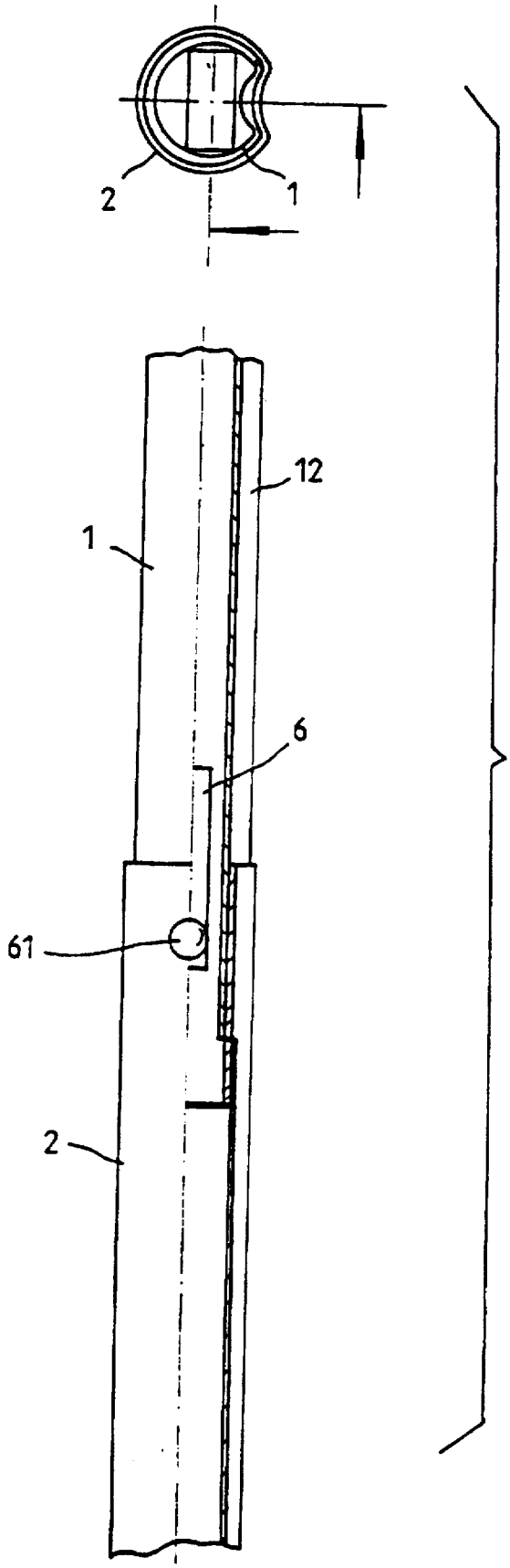
FIG. 4 is a quartered cross sectional view of FIG. 3 in assembly.
Figure 5:
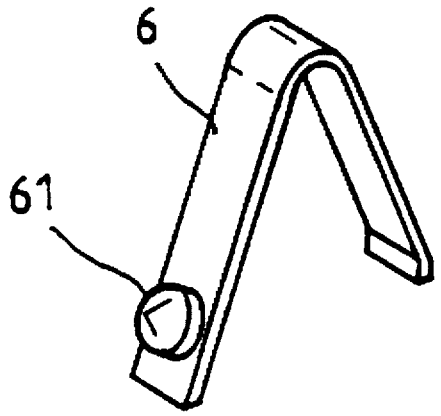
FIG. 5 is a perspective view of a V-shaped stopper according to this invention.

Referring to FIGS. 3 to 5, the rod of the present invention includes an outer tube (2) having a hole (21) and an arched groove (23) which is separated by a step (22) into an upper groove (23') and a lower groove (23"), an inner tube (1) having a groove (12) and a hole (11). The groove (12) is also provided with a step (13). A V-shaped stopper (6) having a projection (61) on one end is disposed in the inner tube (1) wherein the projection (61) is extended from the hole (11) of the inner tube (1). When the inner tube (1) is inserted into the outer tube (2), the projection (61) is capable of extending from the hole (21) of the outer tube (2), that makes a secure positioning between the inner tube (1) and the outer tube (2).

An important characteristic of the invention is that the arch of groove (23') (shown in FIG. 3A) of the outer tube (2) is larger than the arch of the groove (23") (shown in FIG. 3B) and is equal to the arch groove (12) of the inner tube (1) (shown in FIG. 3C). When the inner tube (1) is disposed into the outer tube (2), the connection between both will be very secure and firm because the projection (61) extending from the holes (11) and (21) as well as the interference contact between the groove (23) and the groove (12).

Under the structure of this invention, the advantages include that the manufacturing will be easier than a prior one because of simple configuration of the V-shaped stopper and tubes, the assembling of each means will be convenient, and positioning of the tubes will be secure and firm when the rod is stretched.

From the above description, evidently the present invention can achieve the purposes of promoting the efficiency and convenience in use. It has originality and practical value and thus meets the essence a patent.

I claim:

1. An umbrella rod structure formed by multiple tubes, comprising:

a longitudinally extended outer tube having a first hole formed through a wall thereof and a first arched groove formed longitudinally therein, said first arched groove being separated into respective upper and lower groove portions by a step, said upper groove portion being dimensioned larger than said lower groove portion;

a longitudinally extended inner tube slidingly disposed within said outer tube and having a second hole formed through a wall thereof and alignable with said first hole, said inner tube having a second arched groove formed longitudinally therein and disposed in corresponding relationship with said first arched groove, said second arched groove having dimensions substantially equal to said upper groove portion of said first arched groove, said second arched groove having a step formed therein; and, a V-shaped stopper disposed in said inner tube, said stopper having a projection extending therefrom for passing through said aligned first and second holes to secure a position of said outer tube relative to said inner tube.

* * * * *